US006035756A

United States Patent [19]

Cho

[11] Patent Number: 6,035,756

[45] Date of Patent: Mar. 14, 2000

[54] EGG CASE CUTTING APPARATUS FOR USE IN A REFRIGERATOR

[75] Inventor: Hong-Min Cho, Seoul, Rep. of Korea

[73] Assignee: Daewoo Electronics Co., Ltd., Seoul, Rep. of Korea

[21] Appl. No.: 08/995,757

[22] Filed: Dec. 22, 1997

[30] Foreign Application Priority Data

Dec. 26, 1996 [KR] Rep. of Korea ..... 96-71979

[51] Int. Cl.[7] ..... B26D 5/08

[52] U.S. Cl. ..... 83/487; 83/488; 83/614; 83/603

[58] Field of Search ..... 83/601, 603, 624, 83/487, 488, 614

[56] References Cited

U.S. PATENT DOCUMENTS

| | | | |
|---|---|---|---|
| 5,044,241 | 9/1991 | Labrecque | 83/614 |
| 5,322,001 | 6/1994 | Boda | 83/614 |
| 5,524,515 | 6/1996 | Boda | 83/614 |
| 5,779,851 | 7/1998 | Ifkovits et al. | 83/614 |

*Primary Examiner*—M. Rachuba
*Attorney, Agent, or Firm*—Pillsbury Madison & Sutro LLP

[57] ABSTRACT

An egg case cutting apparatus for use in a refrigerator is disclosed. The apparatus is comprised of a pocket for accommodating the egg case, a guide rail disposed along a longitudinal direction of the pocket, a body being formed with a guide hole through which the guide rail passes, and a cutting member installed in the body. When the body is moved, the edge of the egg case is inserted into the body and is cut by the cutting member. The cut part is discharged outside through a discharge port formed on the body.

9 Claims, 4 Drawing Sheets

EGG CASE CUTTING APPARATUS FOR USE IN A REFRIGERATOR

BACKGROUND OF THE INVENTION

1. Field of the Invention

The present invention relates to an egg case cutting apparatus for use in a refrigerator, and more particularly to an apparatus for cutting an edge of an egg case accommodated in a pocket which is mounted on an inner side of a door of a refrigerator.

2. Prior Art

FIG. 1 shows a general refrigerator. In general, a plurality of pockets 5 for accommodating food are mounted on the inner side of the door 7 of the refrigerator. The pockets 5 are used for storing small products such as a beverage bottle or a can, and the pocket 1 mounted on the uppermost part is generally used for accommodating eggs. A plurality of recesses 3 are formed at the pocket 1 in order to accommodate the eggs one by one.

In general the eggs sold in a market are accommodated in a plastic case. The egg case accommodates about ten eggs, and the edge of the egg case is fastened by iron pins. In order to store the eggs in the pocket 1, the pins are removed and the eggs are accommodated manually in the recesses 3 one by one.

However, there is a problem that the door 7 of the refrigerator is opened for a long period of time during the process for accommodating the eggs in the recesses 3. Thus the loss of the cool air in the refrigerator occurs. Furthermore, the user often makes an error to drop the eggs when he detach the pins in order to open the egg case, which may cause breakage of the eggs.

SUMMARY OF THE INVENTION

The present invention has been proposed to overcome the above described problems in the prior art, and accordingly it is the object of the present invention to provide an egg case cutting apparatus for use in a refrigerator which can cut the egg case accommodated in the pocket, whereby inconvenience accommodating the eggs one by one does not occur, and the loss of the cool air which is caused when the door is opened for a long period of time in order to accommodate the eggs is prevented.

To achieve the above object, the present invention provides an egg case cutting apparatus for use in refrigerator comprising: a pocket being mounted on an inner side of a door of said refrigerator, said pocket for accommodating said egg case; a guide rail being disposed along a longitudinal direction of said pocket; and a cutting device, cutting means for cutting an edge of said egg case.

Said cutting means comprises a hollow body being formed with a guide hole through which said guide rail passes; and a cutting member being installed in said body, said cutting member for cutting the edge of said egg case inserted into said body when said body is moved.

Further, said guide rail is formed with teeth along a longitudinal direction thereof, and said cutting member is comprised of a disc-shaped blade part and a pinion which is tooth-engaged with the teeth of said guide rail. Therefore, the edge of said egg case is cut by a rotation of said blade part when said body is moved along said guide rail.

Moreover, said body is formed with a discharge port through which a cut part of said egg case is discharged outside said body, and a guide protrusion is formed at an inner side of said body in order to guide said cut part to be discharged through the discharge port.

It is preferable that a knob for moving said body is mounted at an outer side of said body.

According to a preferred embodiment of the present invention, said pocket is pivotabe about one end thereof.

Furthermore, a hooking protrusion is formed at the other end of said pocket, and a hooking recess assembled with said hooking protrusion is formed at an inner side of said door.

Therefore, it is more convenient to use the egg case cutting apparatus.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
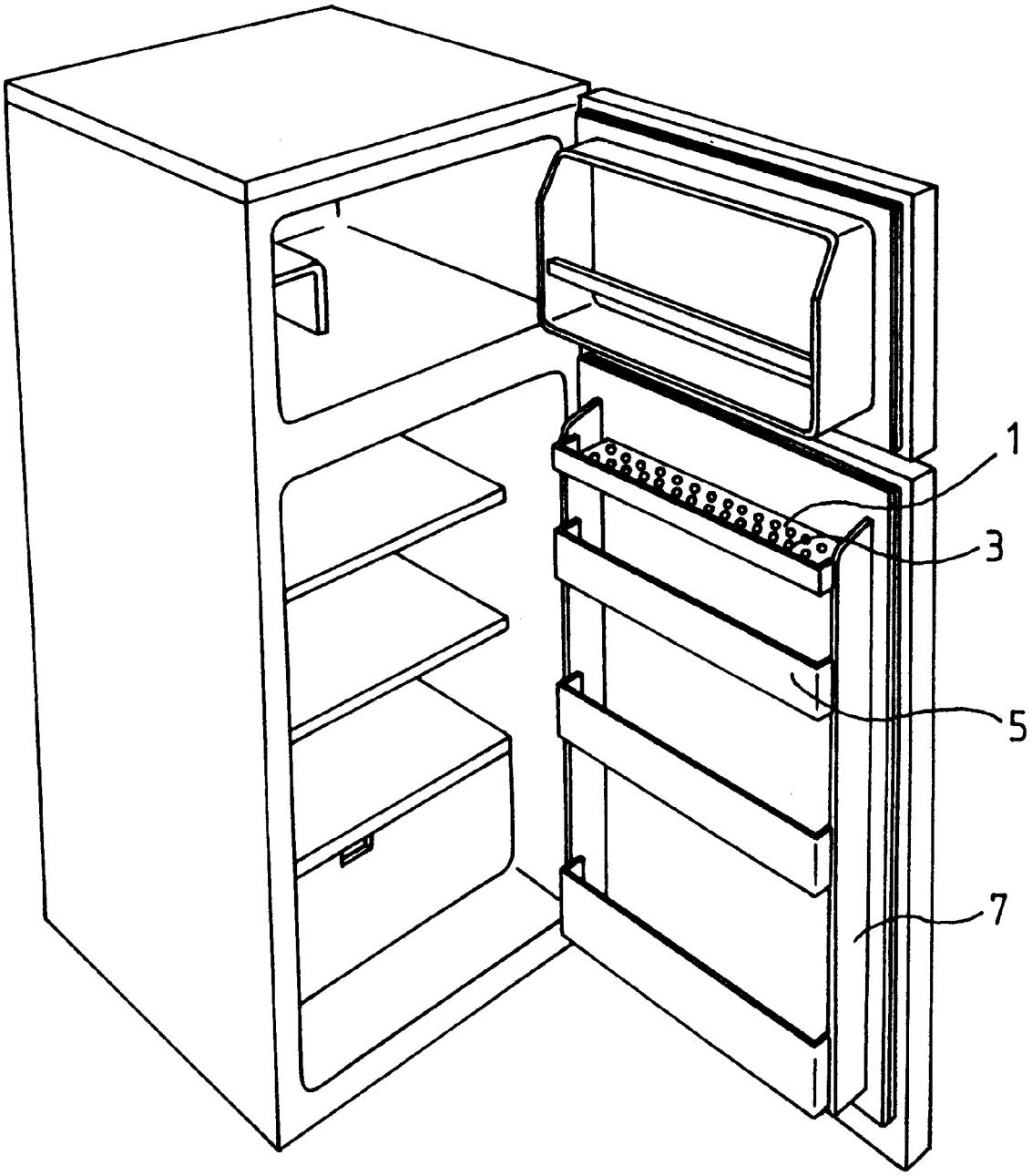
FIG. 1 PRIOR ART
FIG. 1 is a perspective view of a general refrigerator.
Figure 2:
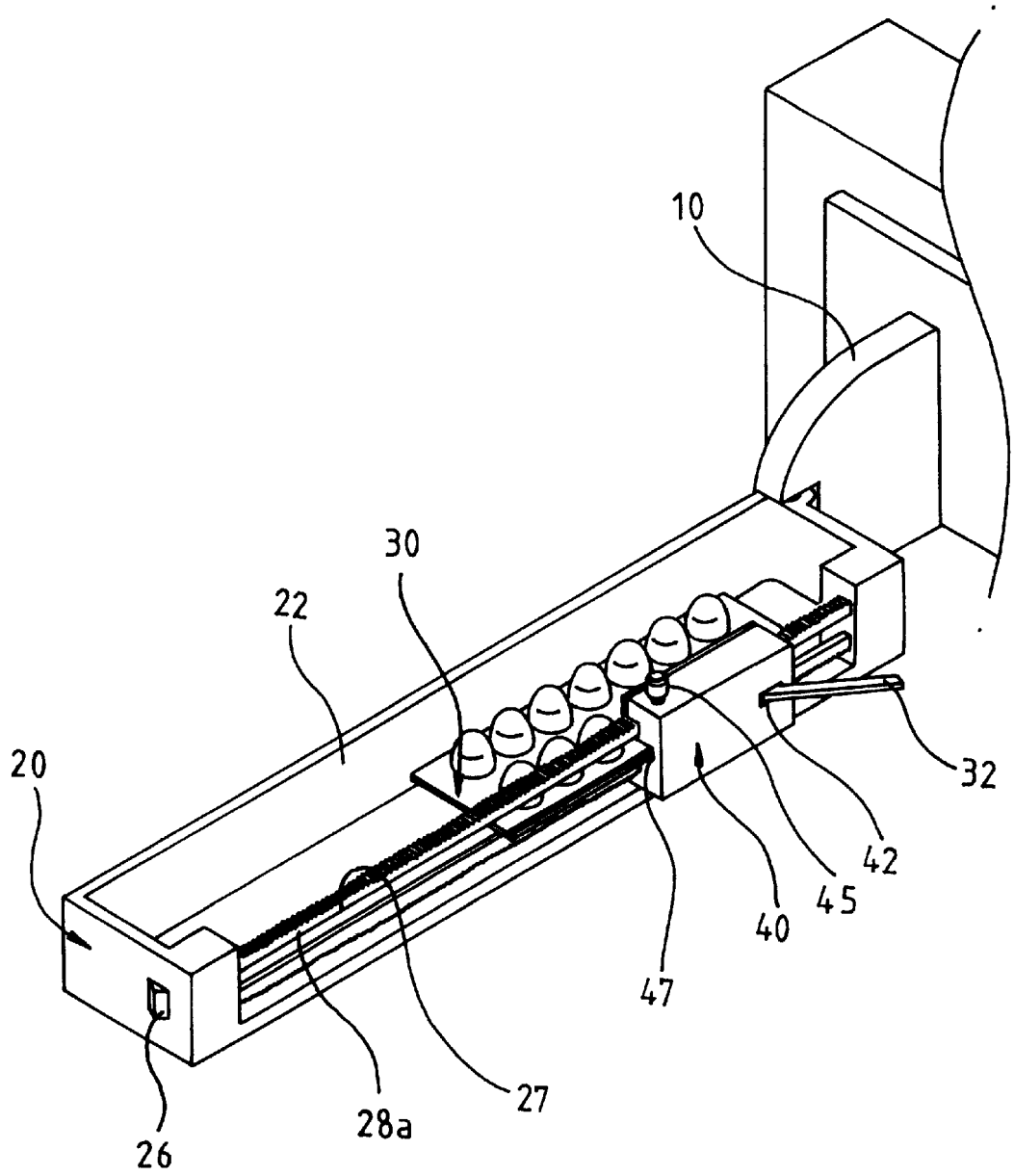
FIG. 2 is a perspective view of an egg case cutting apparatus according to the present invention.
Figure 3:
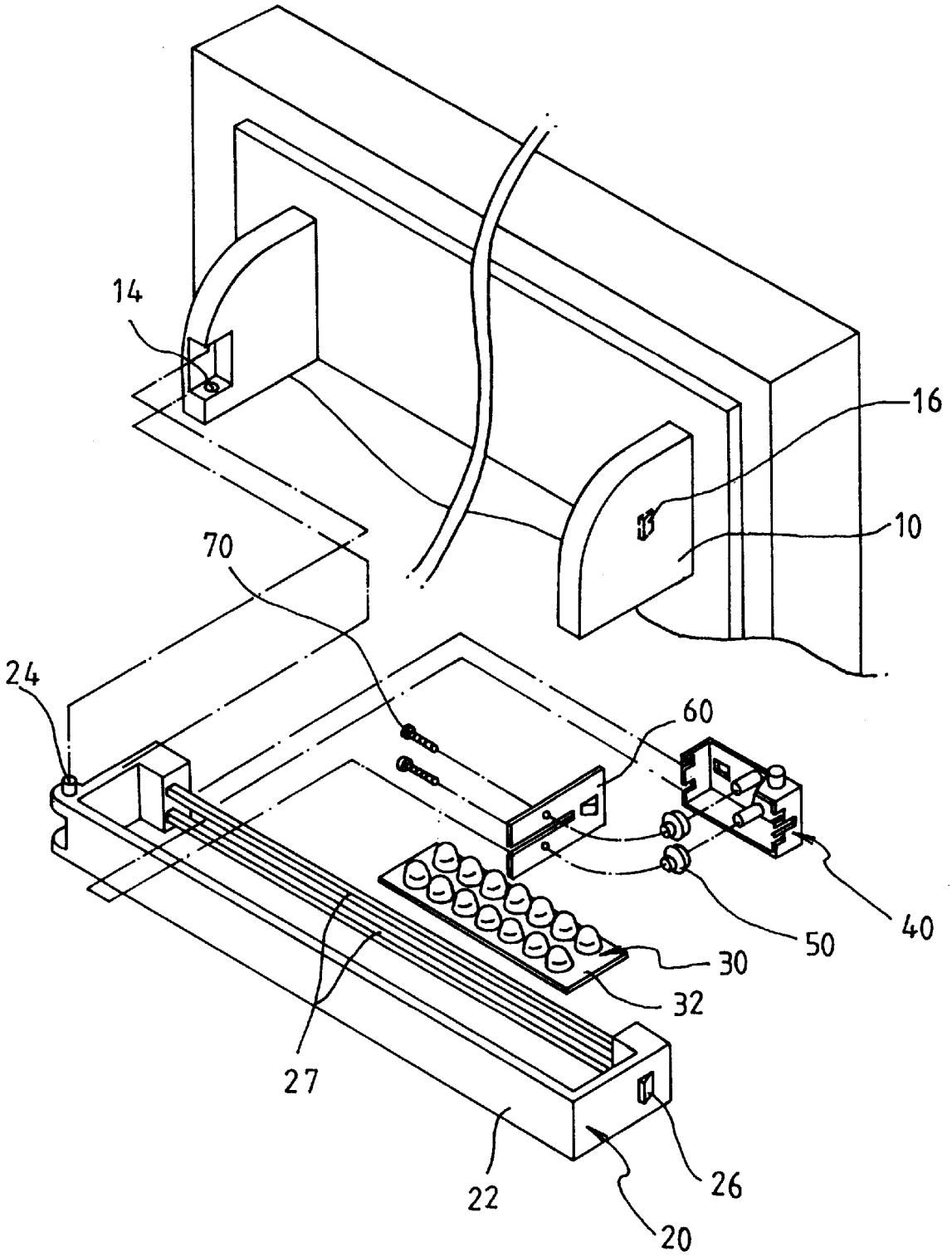
FIG. 3 is an exploded perspective view of FIG. 2.
Figure 4:
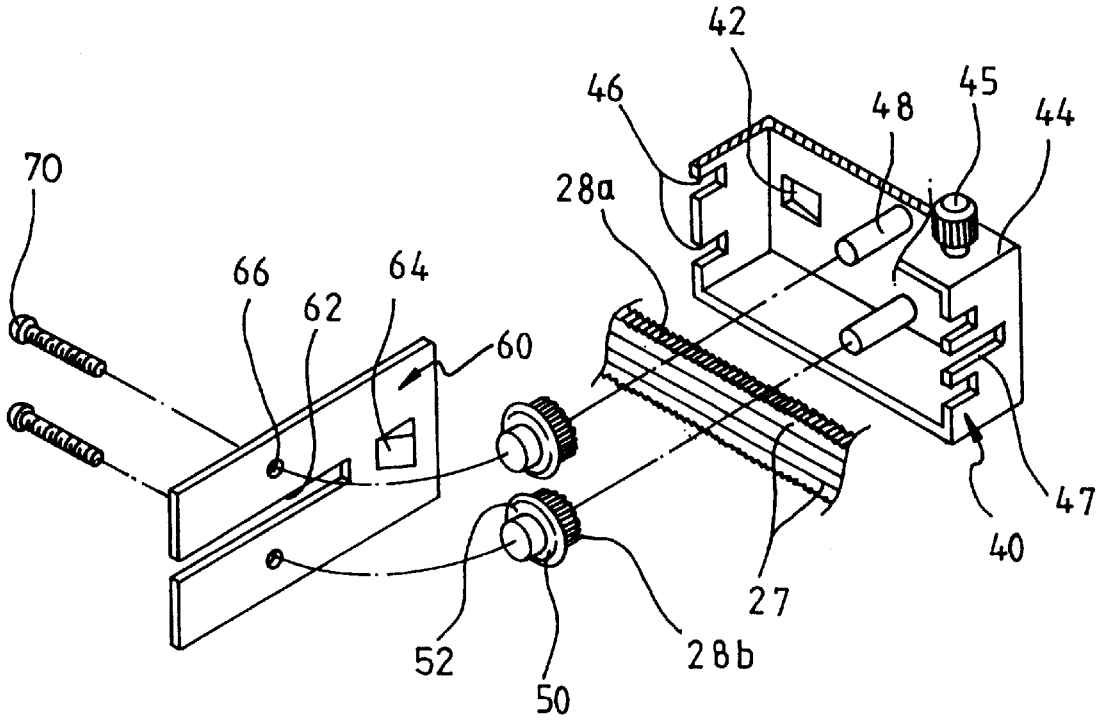
FIG. 4 is a partial enlarged perspective view of FIG. 3.

FIG. 2 through FIG. 4 show an egg case cutting apparatus according to the present invention.

The egg case cutting apparatus according to the present invention has a pocket 20, a pair of guide rails 27, and a body 40.

The pocket 20 is mounted on the inner side of the door of the refrigerator. The pocket 20 is supported by a pair of supporting plates 10 formed at the inner side of the door. The pocket 20 has a fence 22 at the outer side thereof, whereby an accommodation part for accommodating the egg case 30 is formed.

A hinge pin 24 is formed at one end of the pocket 20, and a hinge port 14 with which the hinge pin 24 is assembled is formed at one supporting plate 10. Thus, the pocket 20 is mounted to be pivotable about the hinge pin 24.

A hooking protrusion 26 is formed at the other end of the pocket 20, and a hooking recess 16 assembled with the hooking protrusion 26 is formed at the other supporting plate 10. The pocket 20 is fixed at the inner side of the door by the assembly of the hooking protrusion 26 and the hooking recess 16.

The guide rails 27 are disposed along the longitudinal direction of the pocket 20. Each guide rail 27 is formed with teeth 28*a* along the longitudinal direction thereof.

The body 40 is comprised of a housing 44 and a cover 60. A pair of assembly protrusions 48 with which screws are assembled are formed at the inner side of the housing 44, and a pair of holes 66 through which the screws 70 pass are formed at the cover 60. The housing 44 is covered by the cover 60 and then the screws 70 are screwed to the assembly protrusions 48 through the holes 66, whereby the housing 44 and the cover 60 are assembled with each other.

The housing 44 is formed with guide holes 46 through which the guide rails 27 pass. The cover 60 is assembled with the housing 44 in the state that the guide rails 27 are accommodated in the guide holes 46. Therefore, the guide rails 27 pass through the body 40, and then the movement of the body 27 is guided by the guide rails 27.

A pair of cutting members 50 are assembled with the assembly protrusions 48. Each cutting member 50 is comprised of a disc-shaped blade part 52 and a pinion part 28*b* which is tooth-engaged with the teeth of the guide rail 27. When the body 40 is moved along the guide rails 27, the blade parts 52 are rotated by the teeth 28*a* and the pinion part 28*b*.

The housing 44 is formed with an insertion recess 47 into which an edge of the egg case 30 is inserted, and the cover 60 is formed with an insertion groove 62. The edge of the egg case 30 accommodated in the pocket 30 is inserted into the body 40 through the insertion recess 47 and the insertion groove 62. Therefore, when the body 40 is moved along the guide rails 27, the edge of the egg case 30 which is inserted into the body 40 is cut by the cutting member 50.

The housing 44 is formed with a discharge port 42 for discharging a cut part 32 of the egg case outside, and a guide protrusion 64 for guiding the cut part 32 to be discharged through the discharge port 42 is formed at the inner side of the cover 60.

A knob 45 for moving the body 40 is mounted on the upper part of the housing 44.

Hereinbelow, the operation and the effect of the egg case cutting apparatus according to the present invention will be described.

The egg case 30 is accommodated in the pocket 20. The egg case 30 is placed so that the edge thereof lies between two guide rails 27.

The user grasps the knob 45, and then moves the body 40. When the body 40 is moved, the edge of the egg case 30 is inserted into the body 40 through the insertion recess 47 and the insertion groove 62. The inserted edge of the egg case 30 is cut by the blade parts 52 which are rotated by the movement of the body 40. The cut part 32 is guided toward the discharge port 42 by the guide protrusion 64, and then discharged outside the body 40 through the discharge port 42.

According to the present invention, the egg accommodated in the egg case 30 need not be stored manually in the pocket one by one. The user accommodates the egg case 30 in the pocket 20, and then he can cut the egg case 30 by a simple operation if he wants to.

Further, the user can pivot the pocket 20 by disassembling the hooking protrusion 26 from the hooking recess 16. Therefore, the user can put the egg case cutting apparatus at any handy position by pivoting the pocket 20.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. An egg case cutting apparatus for use in refrigerator comprising:

a pocket mounted on an inner side of a door of said refrigerator, said pocket for accommodating said egg case;

a guide rail being disposed along a longitudinal direction of said pocket; and cutting means for cutting an edge of said egg case by moving along said guide rail;

wherein said cutting means comprises:

a hollow body formed with a guide hole through which said guide rail passes, and formed with a discharge port at one side of said body for discharging a cut part of said egg case the hollow body being adapted to contact the guide rail and moveable therealong; and a cutting member installed in said body, said cutting member for cutting the edge of said egg case inserted into said body when said body is manually moved by a user.

2. The egg case cutting apparatus as claimed in claim 1, wherein said guide rail is formed with teeth along a longitudinal direction thereof, and said cutting member is comprised of a disc-shaped blade part and a pinion which is tooth-engaged with the teeth of said guide rail, wherein the edge of said egg case is cut by a rotation of said blade part when said body is manually moved along said guide rail.

3. The egg case cutting apparatus as claimed in claim 1, wherein said body further comprises a guide protrusion formed at an inner side of said body, said guide protrusion for guiding said cut part to be discharged through the discharge port.

4. The egg case cutting apparatus as claimed in claim 1, wherein said body further comprises a knob mounted at an outer side of said body, said knob to grasp for moving said body manually by the user.

5. The egg case cutting apparatus as claimed in claim 1, wherein said pocket is pivotably mounted on the inner side of the door.

6. The egg case cutting apparatus as claimed in claim 5, wherein said pocket includes:

a hooking protrusion formed at an outer end of said pocket; and a hooking recess formed at the inner side of said door and which accommodates said hooking protrusion.

7. An egg case cutting apparatus for use in refrigerator comprising:

a pocket mounted on an inner side of a door of said refrigerator to be pivotable about one end thereof, said pocket for accommodating said egg case;

a guide rail disposed along a longitudinal direction of said pocket, said guide rail formed with teeth along a longitudinal direction thereof;

a cutting means including a hollow body formed with a guide hole through which said guide rail passes, and a cutting member comprised of a disc-shaped blade part and a pinion which is tooth-engaged with the teeth of said guide rail, said cutting member for cutting an edge of said egg case which is inserted into said body by a rotation of said blade part when said body is moved along said guide rail; and a knob mounted at an outer side of said body, said knob for moving said body.

8. The egg case cutting apparatus as claimed in claim 7, wherein said body is formed with a discharge port through which a cut part of said egg case is discharged outside said body.

9. The egg case cutting apparatus as claimed in claim 8, further comprising a guide protrusion formed at an inner side of said body, said guide protrusion for guiding said cut part to be discharged through the discharge port.

* * * * *